United States Patent [19]

Hill et al.

[11] 4,124,009

[45] Nov. 7, 1978

[54] SPARK IGNITION SYSTEM FOR AN INTERNAL COMBUSTION ENGINE

[75] Inventors: William F. Hill, Stafford; Norman A. Jukes, Walsall, both of England

[73] Assignee: Lucas Industries Limited, Birmingham, England

[21] Appl. No.: 707,795

[22] Filed: Jul. 22, 1976

[30] Foreign Application Priority Data

Jul. 31, 1975 [GB] United Kingdom ..... 31982/75

[51] Int. Cl.[2] ..... F02P 3/04

[52] U.S. Cl. ..... 123/148 E; 315/209 T

[58] Field of Search ..... 123/148 E; 315/209 T

[56] References Cited

U.S. PATENT DOCUMENTS

| | | | |
|---|---|---|---|
| 3,087,090 | 4/1963 | Konopa | 123/148 E |
| 3,482,560 | 12/1969 | Höhne | 123/148 E |
| 3,749,974 | 7/1973 | Kissel | 123/148 E |
| 3,797,471 | 3/1974 | Schuette | 123/148 E |
| 3,831,571 | 8/1974 | Weber | 123/148 E |
| 3,841,288 | 10/1974 | Korteling | 123/148 E |
| 3,881,458 | 5/1975 | Roozenbeek et al. | 123/148 E |
| 4,008,698 | 2/1977 | Gartner | 123/148 E |
| 4,044,733 | 8/1977 | Suda | 123/148 E |

*Primary Examiner*—Charles J. Myhre
*Assistant Examiner*—Andrew M. Dolinar
*Attorney, Agent, or Firm*—Ladas, Parry, Von Gehr, Goldsmith & Deschamps

[57] ABSTRACT

An internal combustion engine spark ignition system includes a transducer and a transducer circuit which coact to produce a rectangular pulse for each spark required. The leading edge of this pulse controls an input transistor which controls an output transistor through an intermediate transistor. The output transistor in turn controls an ignition circuit controlling the current through an ignition coil. The coupling between the intermediate and output transistors includes a resistance chain to points in which two timing capacitors are connected. At high speeds the circuit provides a fixed coil current duty cycle with a relatively short off time, whereas, at low speeds the duty cycle is determined by the length of the pulses from the transducer circuit giving a relatively long off time.

5 Claims, 1 Drawing Figure

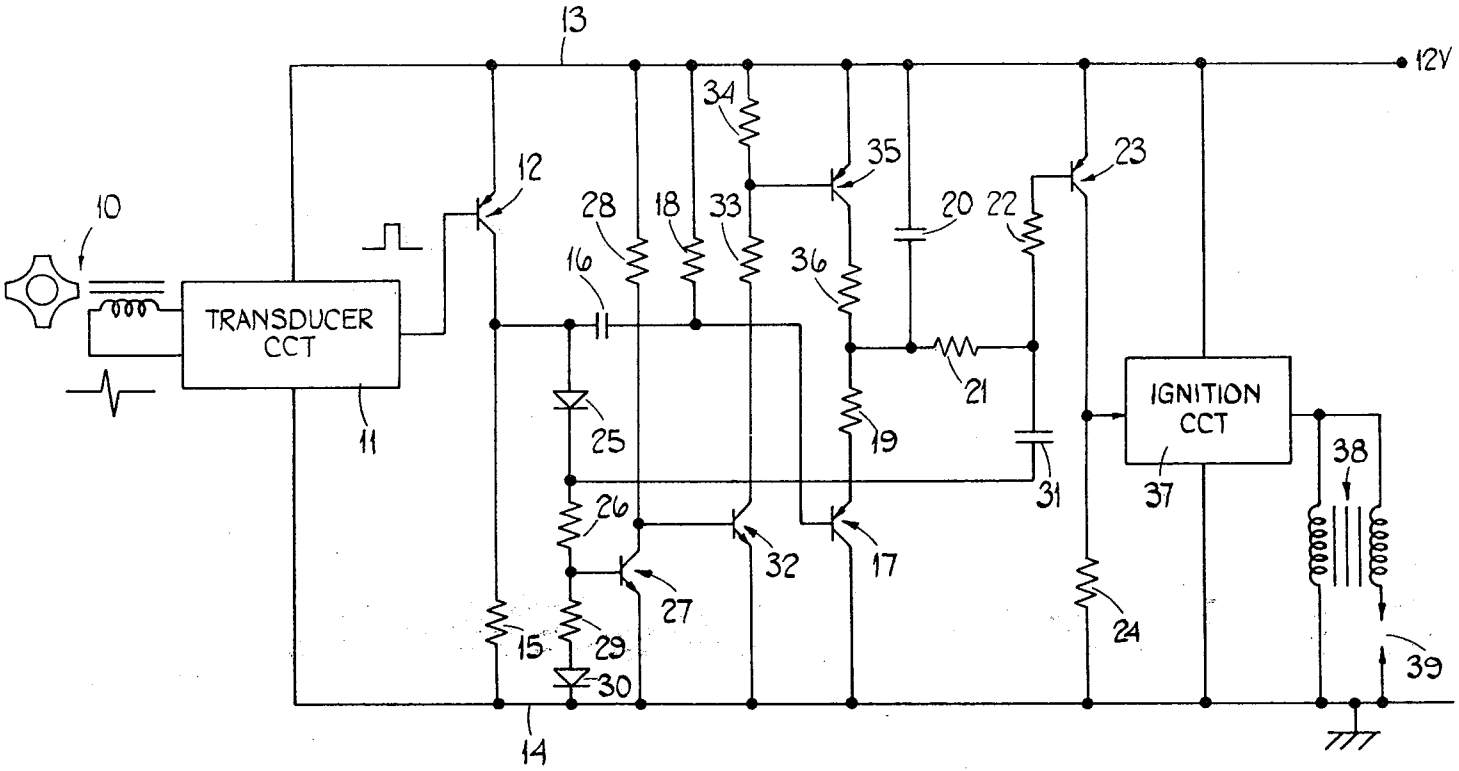
12V
IGNITION CCT
TRANSDUCER CCT
10
11
12
13
14
15
16
17
18
19
20
21
22
23
24
25
26
27
28
29
30
31
32
33
34
35
36
37
38
39

SPARK IGNITION SYSTEM FOR AN INTERNAL COMBUSTION ENGINE

This invention relates to a spark ignition system for an internal combustion engine.

In a conventional spark ignition system a contact breaker controls the current through the primary winding of an ignition coil so that breaking of the current flow through the coil causes a spark. With such a system the mark-space ratio of the coil current is constant and there is also a danger of the ignition being left switched on when the engine has stopped with the contact breaker closed, which would drain current from the vehicle battery and also overheat (perhaps to destruction) the primary winding. Overheating can also occur at low engine speeds.

It has already been proposed to vary the current-on time of the ignition coil in an electronic ignition system by determining the time between switch-off and switch-on in accordance with the duration of the last preceding cycle to give, in steady running conditions, current-on time just adequate for the coil-current to build up to near its maximum value. Such a system, however, suffers from the disadvantage that its response to sudden acceleration, particularly at low engine speeds, is poor in that the instant of switch-on as determined by the preceding cycle can, in these conditions, occur after the instant when switch-off is required. Thus, in order to allow for sudden acceleration the instant of switch-on is always fixed rather earlier than necessary for coil current build up and the hoped for saving in power dissipation is not achieved. It is an object of the invention to provide a spark ignition system in which power dissipation can be reduced substantially as compared with known electrically controlled systems and in which the problem of current drain with the engine stopped is also substantially overcome.

A system in accordance with the invention comprises a transducer producing for each spark required, first and second signals separated by an interval which reduces as the engine speed increases, an ignition circuit including an ignition coil, and a triggering control circuit connecting the transducer to the ignition circuit, said triggering control circuit operating at high engine speeds to switch off the ignition circuit for a period commencing with the second signal and of duration increasing as engine speed decreases, and at low speeds to turn the ignition circuit on and off on receipt of said first and second signals respectively, the ignition circuit being normally turned off by the triggering circuit except when said signals are received from the transducer.

Preferably the triggering control circuit operates at high speeds so as to decrease the ignition circuit duty ratio as engine speed decreases, i.e., the "off" time is an increasing fraction of the cycle time.

Preferably the triggering control circuit includes first signal storage means arranged to receive an input as a result of receipt of the first signal and to store such input for a first storage period exceeding the maximum interval between sparks. There may also be a second signal storage means arranged to receive an input as a result of the second signal and to store such input for a second storage period less than the interval between sparks.

The triggering control circuit may be such that the ignition circuit can be held switched on only during said first storage period and is overridingly held switched off during said second storage period.

Preferably the second storage period is limited by the occurrence of the following first signal.

The first and second storage means may be capacitors having appropriate charge/discharge paths selectively controlled by the first and second signals.

An example of the invention will now be described with reference to the accompanying drawing which is a circuit diagram of the ignition system.

Referring to the drawing the system shown includes a variable reluctance pick-up 10 which forms part of a transducer circuit 11 producing an output pulse train of frequency directly proportional to engine speed and of substantially constant mark-to-space ratio. For the purposes of the following description the rising edges of the pulses are referred to as "the first signals" and the falling edges are referred to as "the second signals". It will be appreciated that the interval between the first and second signals reduces as engine speed increases.

The output terminal of the transducer circuit 11 is directly connected to the base of a p-n-p transistor 12 forming the input stage of a triggering control circuit. The emitter of the transistor 12 is connected to a positive supply rail 13 and its collector is connected via a resistor 15 to a grounded negative supply rail 14. The collector of the transistor 12 is also connected via a capacitor 16 to the base of a p-n-p transistor 17, which base is also connected to the rail 13 via a resistor 18. The emitter of the transistor 17 is connected via a resistor 19 to one side of a first signal storage capacitor 20 the other side of which is connected to the rail 13. The common point of the resistor 19 and the capacitor 20 is connected via two resistors 21, 22 in series to the base of an output transistor 23 which has its emitter connected to the rail 13 and its collector connected via a resistor 24 to the rail 14.

The collector of the transistor 12 is also connected to the anode of a diode 25 the cathode of which is connected by a resistor 26 to the base of an n-p-n transistor 27 having its emitter connected to the rail 14 and its collector connected to the rail 13 via a resistor 28. A resistor 29 connects the base of the transistor 27 to the anode of a diode 30 the cathode of which is connected to the rail 14. A second signal storage capacitor 31 connects the cathode of the diode 25 to the common point of the resistors 21, 22. The collector of the transistor 27 is connected to the base of an n-p-n transistor 32, the emitter of which is grounded. The collector of the transistor 32 is connected by two resistors 33, 34 in series to the rail 13, these resistors having their common point connected to the base of a p-n-p transistor 35 having its emitter connected to the rail 13 and its collector connected via a resistor 36 to the common point of the resistor 19 and capacitor 20.

The collector of the transistor 23 is connected to an ignition circuit 37 which includes the ignition coil 38 and a spark plug 39 (of which there are several, the distributor being omitted from the drawing). Current flows through the primary of the ignition coil whenever the transistor 23 is conductive.

The transistor 12 is normally conductive but is switched off by the first signal and on again by the second signal. At high engine speeds the capacitor 20 is charged to a substantial proportion of the rail voltage by recurrent replenishment of the charge via the transistor 17 which operates as an emitter follower, and thus saturates briefly each time the transistor 12 turns off. At such speeds the voltage across the capacitor 20 remains approximately constant. During each period when the transistor 12 is turned off, the capacitor 31 charges, current flowing in the emitter-base junction of the transistor 23, the resistors 22, 26 and 29 and the diode 30. As a result of this charging current drawn from the base of the transistor 23, the latter is held saturated and current flows through the coil.

The second signal switches the transistor 12 back on abruptly, the potentials on both sides of the capacitor 31 go rapidly positively, reverse biasing the transistor 23 and abruptly cutting off current through the coil primary to produce a spark. The transistor 23 then remains non-conductive for the time required for the capacitor 31 to discharge sufficiently via the resistor 21 to permit resumption of base conduction from transistor 23 which rapidly reverts to its former saturated condition. The transistor 23 is therefore overridingly held off by the capacitor 31 so long as it remains charged, and can only be held switched on when the capacitor 20 is charged but the capacitor 31 is not charged. By suitable choice of component values it is arranged that, at maximum engine speed the time for which the transistor 23 is turned off is adequate to ensure a satisfactory ignition spark.

The switching duty ratio of the transistor 23 (and hence the coil) is substantially constant at the high end of the engine speed range, since it is determined by the substantially constant mark-space ratio of the pulses from the transducer circuit, the substantially constant voltage on the capacitor 20 and the ratio of charge and discharge impedances associated with the capacitor 31. This duty ratio is, of course, chosen so that at maximum speed the transistor 23 turns on due to discharge of the capacitor 31 before the transistor 12 turns off. (The second signal storage capacitor 31 stores the input that it receives for a storage period less than the minimum interval between sparks and limited by the turning off of the transistor 12.)

Through the upper speed range the transistors 27, 32 and 35 are ineffective since the transistor 27 is always on either as a result of current through capacitor 31 or as a result of the transistor 12 being on.

As engine speed falls there are two distinct effects which vary the off-time of the transistor 23. Firstly, provided that the capacitor 20 is not of too large a capacitance as compared with the capacitor 31, then discharging of the capacitor 31 also causes discharge of the capacitor 20 which commences each cycle at a constant voltage. As a result, if capacitor 31 starts to discharge from a high voltage, then the time during which the transistor 23 is turned off is extended by reason of the loss of voltage on the capacitor 20 during the latter part of the process. Secondly, if the charging current of the capacitor 31 decays sufficiently while the transistor 12 is still off the transistor 27 turns off, thereby causing the transistor 35 to conduct until the transistor 12 is turned on again. As a result the capacitor 20 is discharged through resistor 36 and the off period of the transistor 23 is extended. The values of the resistor 18 and the capacitor 16 are chosen so that the transistor 17 is off whenever the transistor 35 starts to conduct in this way, so that the voltage on the capacitor 20 when transistor 12 turns on is progressively reduced as the engine speed becomes lower. At a suitably low value of the engine speed, the off time of the transistor 23 becomes extended to the point at which the transistor 12 next turns off, thereby limiting the off time of the transistor 23. At this and lower speeds, the coil duty ratio becomes complementary to that of the transistor 12; hence this speed is chosen to produce off times of the transistor 12 sufficient to allow adequate coil current to develop. The off-time of the transistor 23 is regulated by the off-time of the transistor 12 so that the on-time is always adequate to allow proper coil current build up whilst avoiding high fractional on-times with high coil currents.

The diode 30 and resistor 29 determine the value of the charging current of the capacitor 31 at which the transistor 27 switches. The base current of this transistor is negligible by comparison, at this point in time.

By suitable design, the capacitor 20 does not normally discharge sufficiently to enable the transistor 23 to turn off before the transistor 12 turns on, even at minimum cranking speed. Thus, it may be said that the capacitor 20 stores the input that it receives for a storage period exceeding the maximum interval between sparks.

If with the ignition switch on, the engine comes to reset between the first and second signals, then either a false second signal will be produced or the transistor 12 will remain off (depending on the type of transducer employed — a variable reluctance transducer will produce the second signal if the engine stops suddenly before the reverse polarity portion of the signal is produced). In either case, the transistor 23 will turn off and an incorrectly time spark will be produced, within the normal timing range. By suitable design this range may be made very small.

A mistimed spark outside this range can occur only if the engine is abruptly stalled from a speed high enough for the discharge of the capacitor 31 to have turned on the transistor 23. In this case, the transistor 12 remains saturated and the transistor 23 turns off when the capacitor 20 has discharged sufficiently. This can only occur as a result of gross overload suddenly applied, e.g. when the driver's foot slips off the clutch.

When the system is first switched on the transistor 12 is immediately turned on and transistor 23 remains off. Thus no coil current is drawn at this time. The coil current is only turned on when the transistor 12 is first turned off and remains on until the transistor 12 turns on again.

It is envisaged that a transducer utilising magnetically bistable wire could be used instead of the variable reluctance transducer described above. In such an arrangement a pick-up coil detects the set and reset transitions of a magnetically bistable wire moving through a magnetic field. The signals derived would be used to produce a rectangular pulse train which would operate the circuit as described above.

We claim:

1. A spark ignition system for an internal combustion engine comprising a transducer producing for each spark required, first and second signals separated by an interval which reduces as the engine speed increases, an ignition circuit including an ignition coil, and a triggering control circuit connecting the transducer to the ignition circuit, said triggering control circuit including first and second signal storage means, said control circuit being responsive to said first signal for supplying a first input in charging relation to said first signal storage means and causing said first input to be stored therein for a first storage period exceeding the maximum interval between sparks and being responsive to said second signal for supplying a second input in charging relation to said second signal storage means and causing said second input to be stored therein for a second storage period less than the minimum interval between sparks and limited by the occurrence of the following first signal, said triggering control circuit being such that the ignition circuit can be held switched on only during said first storage period and is overridingly held switched off during said second storage period, and operating at high engine speeds to switch off the ignition circuit for a period commencing with the second signal and of duration increasing as engine speed decreases and to decrease the ignition circuit duty cycles as engine speed decreases, and at low speeds to turn the ignition circuit on and off on receipt of said first and second signals respectively, the ignition circuit being normally turned off by the triggering circuit except when said signals are received from the transducer.

2. A system as claimed in claim 1 in which said first and second storage means are capacitors having appropriate charge/discharge paths selectively controlled by the first and second signals.

3. A spark ignition system for an internal combustion engine comprising a transducer circuit including a transducer and a shaping circuit which produces pulses having rising and falling edges, one pulse being produced for each spark required, a first transistor connected to said shaping circuit so as to be normally conductive, but turned off by said pulses, a second transistor having its base capacitively coupled to the first transistor and biased so as to be non-conductive, said second transistor being turned on by the rising edge of each pulse, a third transistor having its base coupled to the second transistor by a resistor chain so that the third transistor is turned on when said second transistor is turned on, an ignition circuit including an ignition coil, said ignition circuit being connected to the third transistor so that current is allowed to flow through the ignition coil only when said third transistor is on, and timing means comprising first and second capacitors connected to points in said resistor chain for controlling turning off of the third transistor so that at high engine speeds the third transistor is on for a fixed proportion of each engine revolution and at low engine speeds the third transistor is turned on by the rising edge of each transistor circuit pulse.

4. A system as claimed in claim 3 in which said first capacitor is connected between a point on said chain and a supply rail and has connected to it a discharge circuit comprising a fourth transistor, there being also provided a fifth transistor, means connecting the fifth transistor to said fourth transistor so that the fourth transistor is turned off whenever the fifth transistor is turned on, said fifth transistor being held on at high engine speeds by current supplied by the first transistor and by the emitter base of the third transistor through the intermediary of said second capacitor, but turning off periodically at low engine speeds when said second capacitor becomes fully charged.

5. A spark ignition system for an internal combustion engine transducer means producing for each spark required first and second output signals separated by an interval which is approximately inversely proportional to engine speed, an ignition circuit which includes an ignition coil and is quiescently off, and a control circuit connecting the transducer means to the ignition circuit and including first and second storage devices and means for programming said first and second storage devices with first and second stored signals respectively in the interval between said first and second output signals, the first stored signal varying with the duration of said interval in one part of the engine speed range, the second stored signal varying with the duration of said interval in a different part of the engine speed range, each of said stored signals being constant over the part of said engine speed range over which the other stored signal varies, and the ratio of on-time to off-time of the ignition circuit being a function of both said stored signals.

* * * * *